US006467957B2

(12) United States Patent
Yeager

(10) Patent No.: US 6,467,957 B2
(45) Date of Patent: Oct. 22, 2002

(54) ADHESIVE CLOSURE STRIP, BAG AND METHOD

(75) Inventor: James W. Yeager, Mobile, AL (US)

(73) Assignee: Innoflex Incorporated, Mobile, AL (US)

( * ) Notice: Subject to any disclaimer, the term of this patent is extended or adjusted under 35 U.S.C. 154(b) by 0 days.

(21) Appl. No.: 09/836,400

(22) Filed: Apr. 17, 2001

(65) Prior Publication Data

US 2001/0022867 A1 Sep. 20, 2001

Related U.S. Application Data

(63) Continuation of application No. 09/497,347, filed on Feb. 3, 2000, now abandoned.

(51) Int. Cl.[7] ..... B65D 33/20
(52) U.S. Cl. ..... 383/211; 383/62; 383/93
(58) Field of Search ..... 383/62, 93, 210, 383/211

(56) References Cited

U.S. PATENT DOCUMENTS

| | | | | |
|---|---|---|---|---|
| 3,405,861 A | | 10/1968 | Bush | |
| 3,440,696 A | | 4/1969 | Staller | |
| 3,608,707 A | | 9/1971 | Miller | |
| 3,717,244 A | | 2/1973 | Smith | |
| 3,922,464 A | | 11/1975 | Silver et al. | |
| 4,392,897 A | * | 7/1983 | Herrington | 383/93 X |
| 4,599,265 A | | 7/1986 | Esmay | |
| 4,617,683 A | | 10/1986 | Christoff | |
| 4,629,663 A | | 12/1986 | Brown et al. | |
| 4,633,508 A | * | 12/1986 | Sauders | 383/62 X |
| 4,645,711 A | | 2/1987 | Winslow et al. | |
| 4,655,862 A | | 4/1987 | Christoff | |
| 4,691,373 A | | 9/1987 | Ausnit | |
| 4,709,399 A | | 11/1987 | Sanders | |
| 4,896,775 A | | 1/1990 | Boeckmann | |
| 4,898,787 A | | 2/1990 | Min et al. | |
| 4,902,142 A | | 2/1990 | Lammert et al. | |
| 4,909,017 A | | 3/1990 | McMahon et al. | |
| 4,925,316 A | | 5/1990 | Van Erden et al. | |

(List continued on next page.)

FOREIGN PATENT DOCUMENTS

| | | | | |
|---|---|---|---|---|
| EP | 0 528 721 A2 | | 2/1993 | |
| WO | WO 95/13225 | * | 5/1995 | 383/211 |

*Primary Examiner*—Jes F. Pascua
(74) *Attorney, Agent, or Firm*—Wood, Phillips, Katz, Clark & Mortimer

(57) ABSTRACT

A closure element incorporated into a flexible bag to reclose a bag opening includes a resilient structure which carries an adhesive strip. The closure element is secured to one wall of the bag and the resilient strip seals the one wall to the respective other wall of the bag when the walls are pressed together and the resilient structure is compressed. The resilient structure is held compressed by the adhesive strip. In one embodiment, the resilient structure includes a base portion and a wing portion which deflects to allow the adhesive strip to make contact with the other wall. In another embodiment, the base portion deflects to flatten against the wing portion, the wing portion secured to the bag wall. The base portion and the wing portion can be provided with engageable elements which snap together or interlock to provide a closing feel to the closure strip as the adhesive strip seals the bag opening.

10 Claims, 6 Drawing Sheets

U.S. PATENT DOCUMENTS 5,024,537 A 6/1991 Tilman
5,035,518 A 7/1991 McClkintock
5,036,643 A 8/1991 Bodolay
5,050,736 A 9/1991 Griesbach et al.
5,127,208 A 7/1992 Custer et al.
5,157,811 A 10/1992 Bodolay
5,167,455 A 12/1992 Forman
5,344,693 A * 9/1994 Sanders ..... 428/167
5,564,834 A * 10/1996 Porchia et al. ..... 383/211
5,601,368 A 2/1997 Bodolay et al.
5,672,009 A 9/1997 Malin
5,774,954 A 7/1998 Ramsey et al.
5,782,733 A 7/1998 Yeager
5,783,012 A 7/1998 Porchia et al.
5,791,783 A * 8/1998 Porchia et al. ..... 383/211
5,806,984 A 9/1998 Yeager
5,827,163 A 10/1998 Kettner
5,871,607 A * 2/1999 Hamilton et al. ..... 156/221
5,938,339 A 8/1999 Ouchi
5,972,396 A 10/1999 Jurgovan et al.
6,099,940 A * 8/2000 Hamilton et al. ..... 428/178
6,149,304 A * 11/2000 Hamilton et al. ..... 383/211 X

* cited by examiner

ADHESIVE CLOSURE STRIP, BAG AND METHOD

CROSS-REFERENCE TO RELATED APPLICATION

The present application is a continuation of U.S. patent application Ser. No. 09/497,347, filed Feb. 3, 2000 now abandoned.

TECHNICAL FIELD OF THE INVENTION

The present invention relates to recloseable openings, such as for flexible bags. Particularly, the present invention relates to a closure strip using a resealable adhesive portion which at least partly defines a recloseable opening, the closure strip attached to a wall of a flexible bag.

BACKGROUND OF THE INVENTION

Closure strips for recloseable bags are generally known. One type of closure strip includes interlocking profile strips which typically include interlocking tongue and groove elements to seal a bag opening, such as described in U.S. Pat. Nos. 4,756,629, 5,806,984 or 4,909,017.

Another type of closure strip uses a resealable adhesive strip. The resealable adhesive strip uses a removable pressure sensitive adhesive to close a bag opening. A "removable pressure sensitive adhesive" is one which can be peeled off, together with the backing to which it is applied, from a substrate surface without damage to either the adhesive or the substrate. U.S. Pat. Nos. 5,035,518; 4,645,711; 4,599,265; 4,629,663; 3,608,707; 3,922,464; 4,902,142; and 4,709,399, describe pressure sensitive adhesives and/or packaging using pressure sensitive adhesives.

One drawback to interlocking profile strips is that the strips are relatively thick compared to the thickness of the web material which comprises the front and back wall of the associated bag. This relatively increased thickness is required in order to form the interlocking tongue and groove of the interlocking profile strips. The increased thickness of the profile strip requires higher sealing temperature, pressure and dwell time in the formation of the bag. These additional considerations adversely affect the speed and throughput of the bag forming machines.

Resealable adhesive strips suffer the drawback that the strips lack a positive closing which gives the user indication or "feedback" of a complete closure of the resealable bag.

The present inventor has recognized that it would be advantageous to provide a recloseable strip for a bag that has a low profile thickness and which also provides a positive closure indication to the user.

SUMMARY OF THE INVENTION

The present invention provides a recloseable closure strip for an opening, such as for a flexible bag. The closure strip includes an adhesive region and at least one flexible member which deflects during engagement of the adhesive region to an adhesive receiving region of the bag during re-sealing. The deflection of the flexible member provides a positive closing indication or feedback to the user during re-sealing.

The flexible member can be part of a resilient structure which carries the adhesive region such that by engaging the closure strip to reclose the bag, the resilient structure is compressed or squeezed from a relaxed or uncompressed condition to a flattened condition, giving the user a positive feel or indication of the re-sealing of the bag opening. The resilient structure can be significantly thinner in profile than the prior known interlocking profile strips due to the fact that it is functioning only as an indication of sufficient re-sealing pressure and does not perform a sealing function.

The bag can include a companion strip to the closure strip, the companion strip providing an adhesive receiving area or "land" for the adhesive region of the closure strip. The companion strip can be plain or can have a coacting adhesive applied thereto. The adhesive region of the closure strip and the land of the companion strip can include, rather than tacky adhesives, cold sealable, pressure sensitive cohesives which are adherent to each other and are not tacky and adherent to other surfaces.

The closure strip of the invention can include interlocking elements which interlock when the resilient structure is compressed to its flattened condition simultaneously with the adhesive strip contacting the land, to give the user a positive indication of the re-sealing of the bag opening. The resilient structure can include a base portion and a wing portion, one of which is connected to a first wall of the bag, the wing portion extending obliquely from the base portion, and the base portion carrying the adhesive strip. The interlocking elements can be applied one on the base portion and one on the wing portion to interlock when the base portion and the wing portion are flattened together.

The interlocking portions function differently than that of conventional closures since they do not lock the closure, but instead only give the closure the same "feel" or indication of re-sealing as do interlocking closures, but which utilizes an adhesive as the re-sealing means with the adhesive acting independently of the interlocking action of the interlocking portions.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
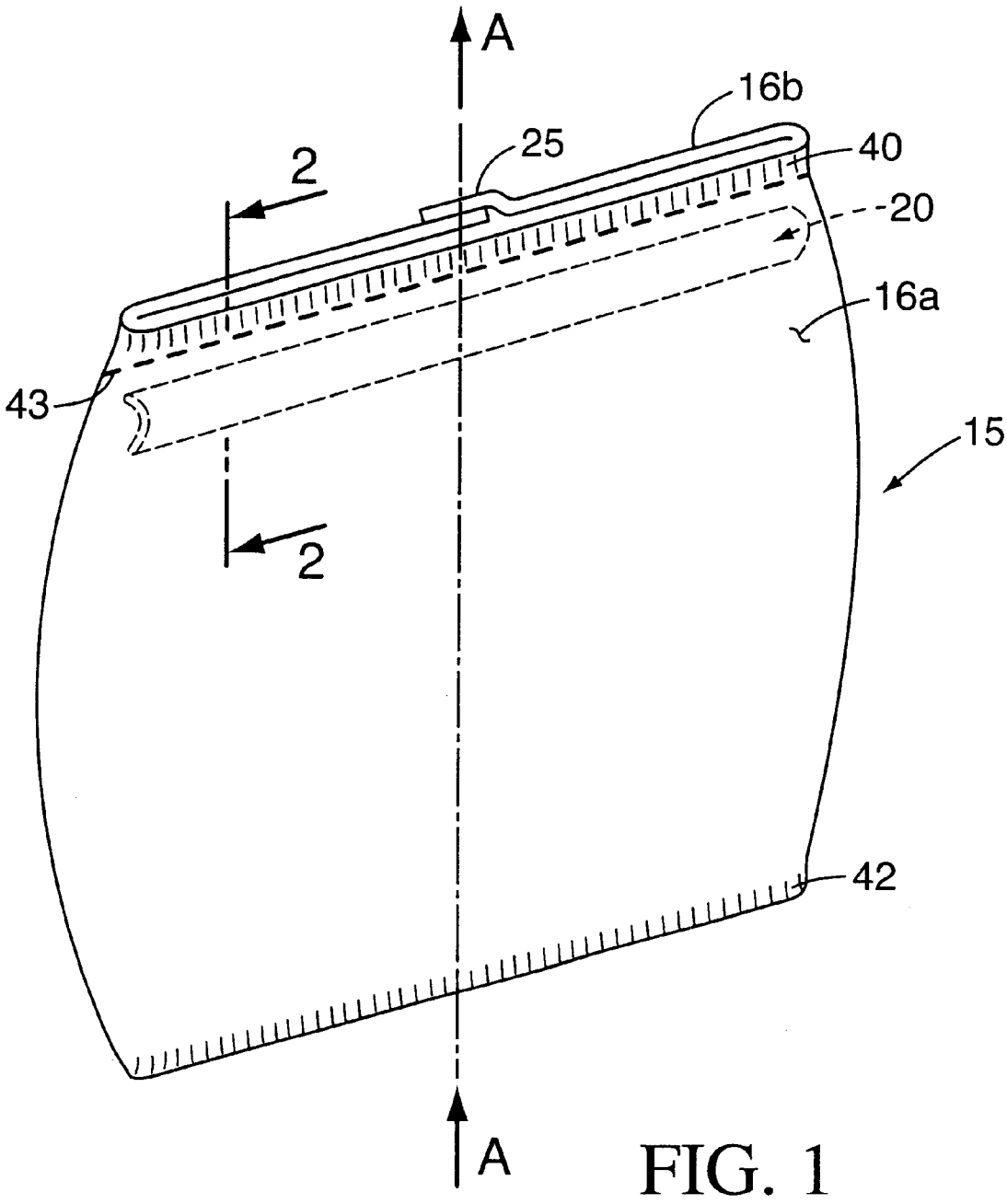
FIG. 1 is a perspective view of a recloseable bag that incorporates the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a bag 15 having a front wall 16*a* and a back wall 16*b*. The bag is formed by folding a sheet of web material and forming a longitudinal seam 25 on the back wall 16*b*. The bag is sealed between the front wall 16*a* and the back wall 16*b* at a top seam 40 and at a bottom seam 42. A line of perforations 43 can be provided along the top seam 40 for initially opening the bag. Alternatively, the top seal 40 can be a non-resealable adhesive or a heat seal as is known, which can be pulled open to initially open the bag. A closure element 20 is applied transversely to the longitudinal direction or formation axis A of the bag 15. The formation axis A is that axis, along which bags are formed connected end-to-end and thereafter separated to form individual bags. The bags and closure elements can be assembled in an apparatus as described in U.S. Pat. Nos. 4,909,017; 3,608,707; 4,617,683; or 6,003,582, all herein incorporated by reference.

Figure 1A:
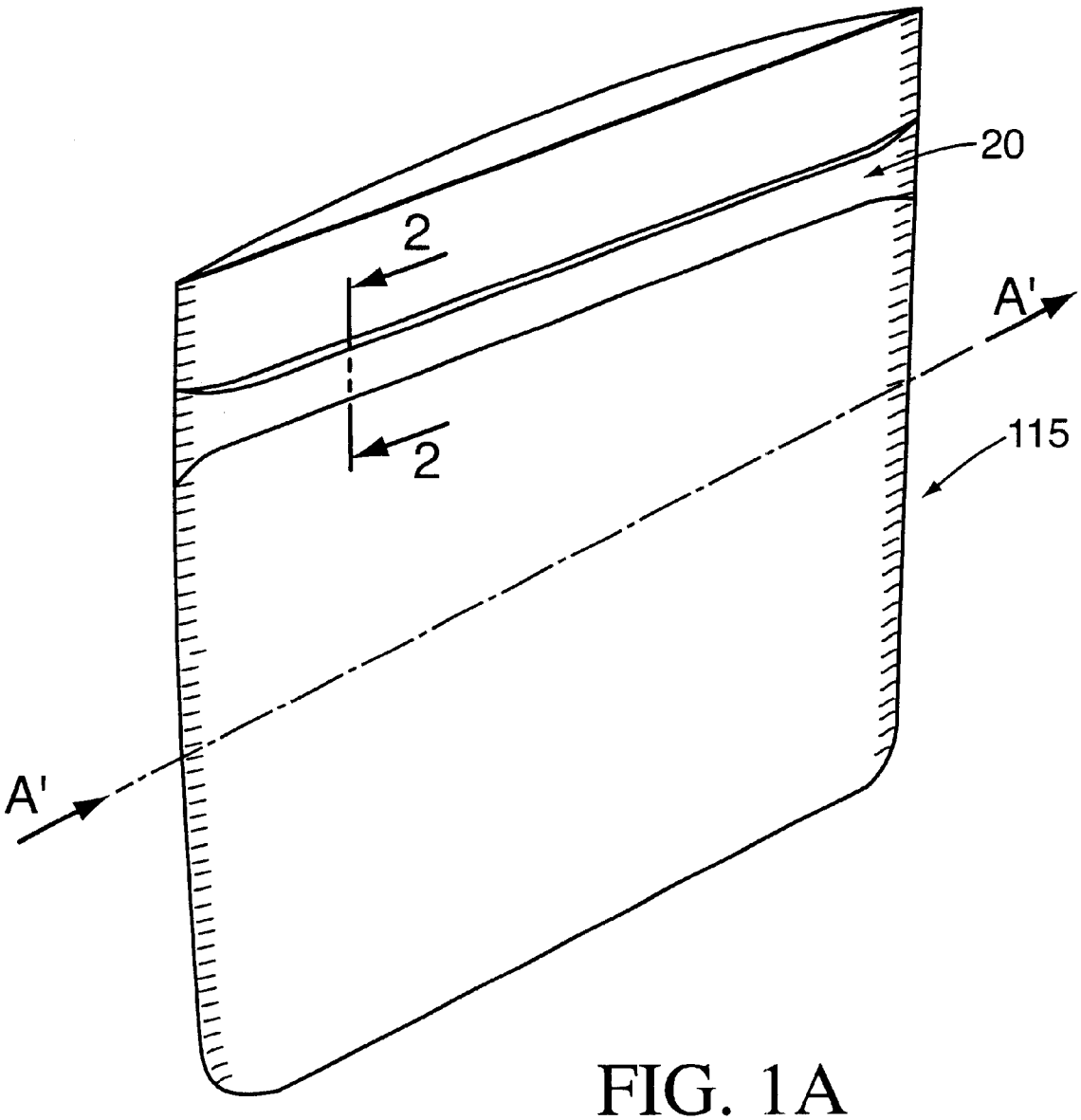
FIG. 1A is a perspective view of another embodiment recloseable bag incorporating the present invention.

FIG. 1A illustrates a bag 115, which is formed along an alternate formation axis A'. Bags in this embodiment are connected side-by-side along the formation axis A' before being separated into individual bags. In this bag 115, the closure element 20 is arranged longitudinally, parallel to the formation axis A'.

Figure 1B:
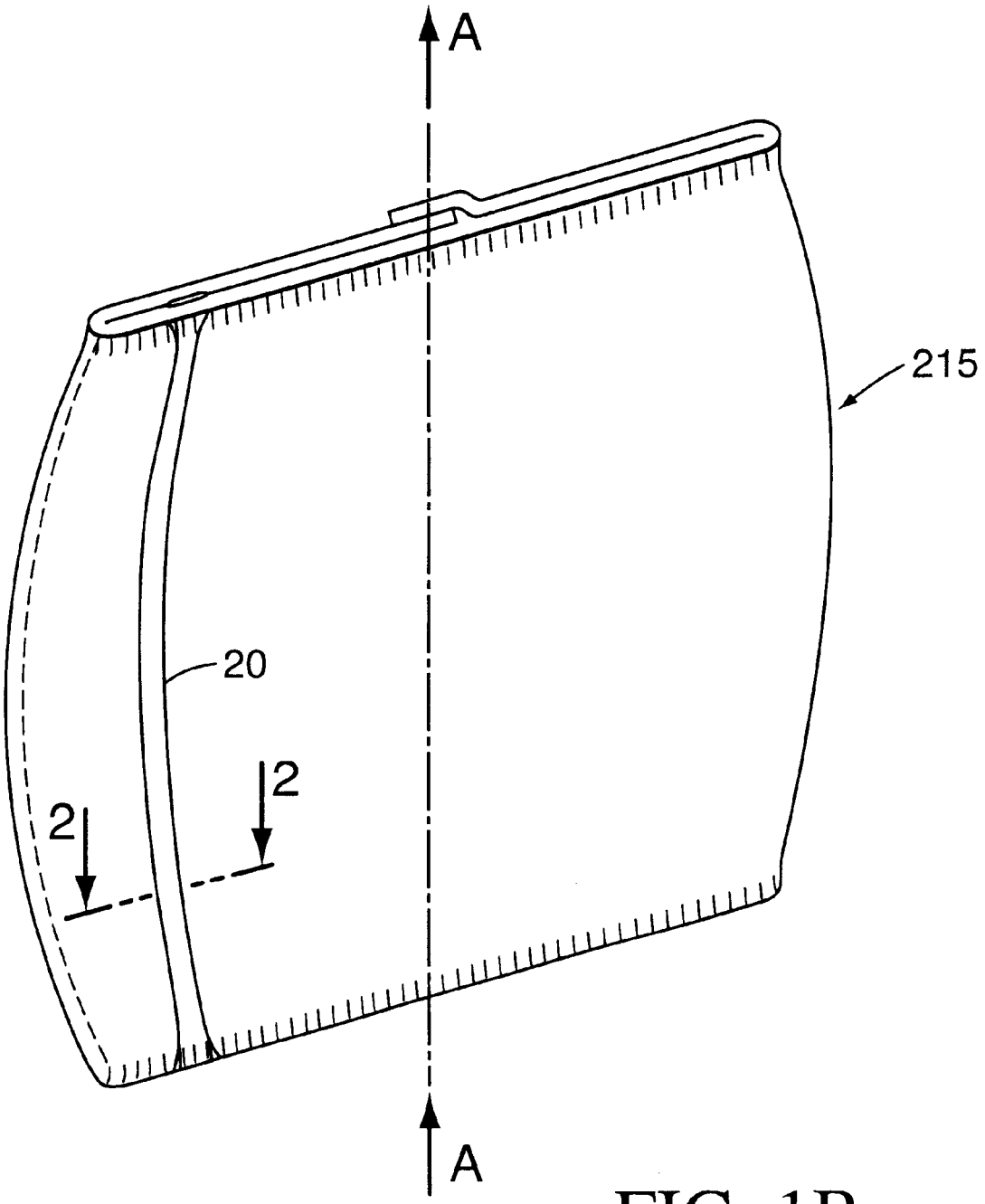
FIG. 1B is a perspective view of a further embodiment recloseable bag incorporating the present invention.

FIG. 1B illustrates a bag 215 which is formed along the formation axis A as in FIG. 1. In this bag 215 however, the closure element 20 is arranged longitudinally, parallel to the formation axis A.

Figure 2:
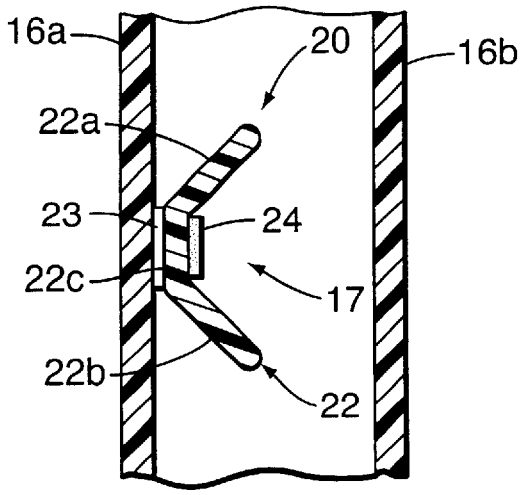
FIG. 2 is a fragmentary sectional view of a portion of the bag taken generally along line 2—2 of either FIG. 1 or FIG. 1A.

FIG. 2 illustrates a closure element 20 secured to the front wall 16*a* of the bag 15, 115, by a known method, such as by a heat seal 23. Alternately, the closure element could be secured to the back wall 16*b* of the bag.

In this embodiment, the closure element 20 is shaped as a trough 22 with wing portions 22*a*, 22*b* which diverge from a base portion 22*c*. A resealable adhesive layer or strip 24 is arranged along the trough 22 on the base portion 22*c*. The adhesive layer can be a removable pressure sensitive adhesive such as described in U.S. Pat. Nos. 5,035,518; 4,645,711; 4,599,265; 4,629,663; 3,608,707; 3,922,464; 4,902,142; and 4,709,399, all herein incorporated by reference. Between the back wall 16*b* and the adhesive strip 24, a bag opening 17 is defined.

Figure 2A:
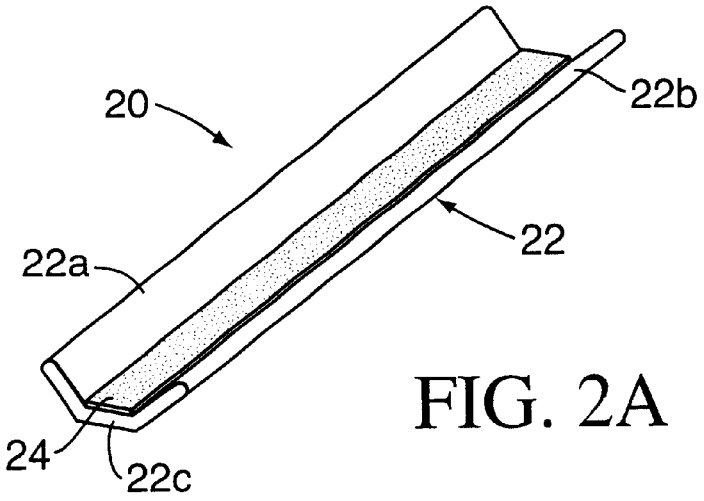
FIG. 2A is a perspective view of a closure element taken from FIG. 1 or FIG. 1A.

FIG. 2A illustrates in perspective the closure strip 20 isolated from the remaining bag components. The strip 20 includes a trough-like structure formed by the wing portions 22*a*, 22*b* and the base portion 22*c*. The adhesive portions 24 is applied onto the base portion 22*c* along the length of the element 20.

Figure 2B:
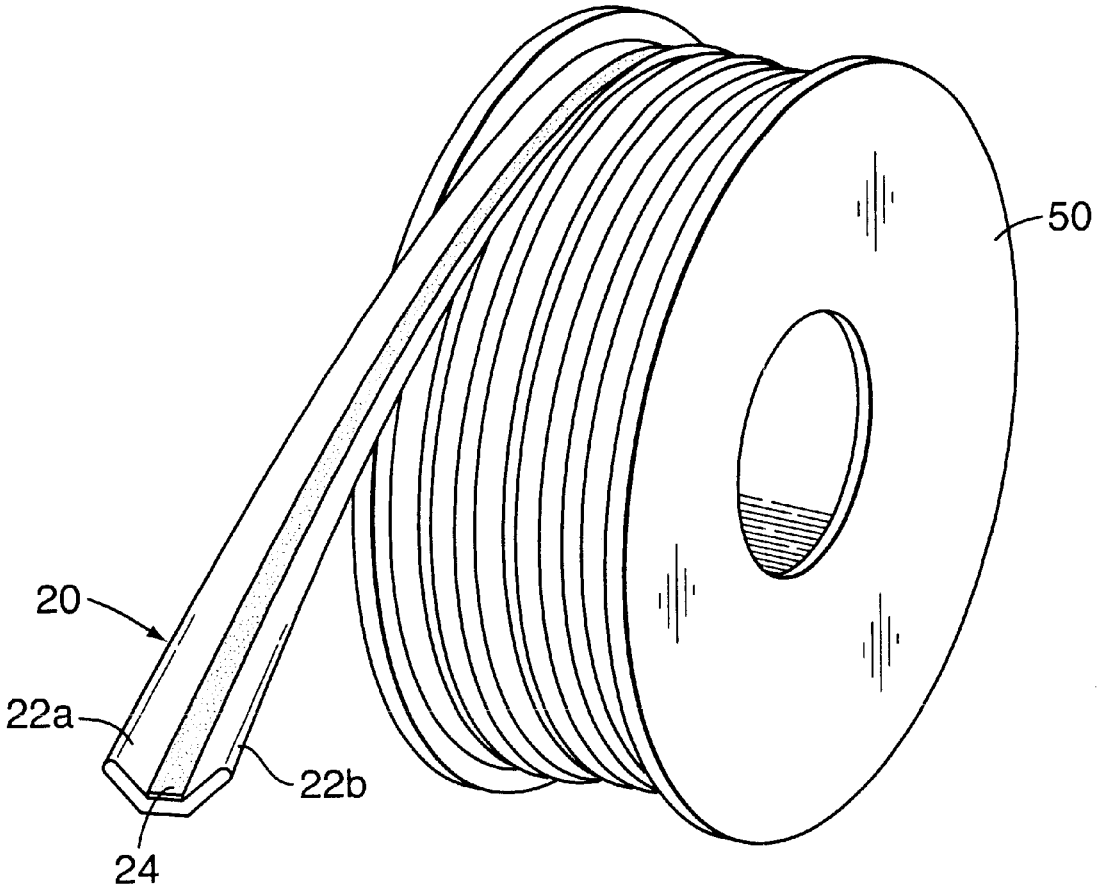
FIG. 2B is a perspective view of a roll of closure element material.

FIG. 2B illustrates that the closure element 20 can be wound in a spool 50. The closure element material can thereafter be dispensed, cut and applied to individual bags in an apparatus, such as described in U.S. Pat. Nos. 4,617,683 or 6,003,582, for applying profile strip fasteners.

Figure 3:
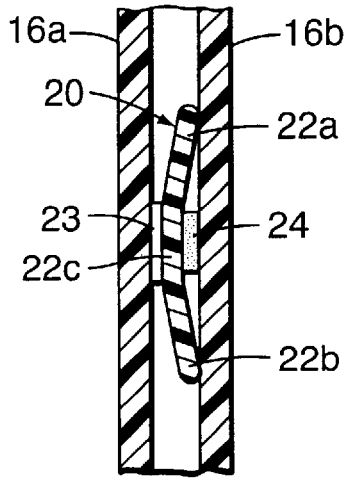
FIG. 3 is a sectional view of the portion shown in FIG. 2 but in a closed configuration.

As illustrated in FIG. 3, the back wall 16*b* and the front wall 16*a* are compressed together by a user's fingers to close the bag opening 17. This action compresses or flattens the trough 22, by resiliently flattening the wing portions 22*a*, 22*b* until the adhesive layer 24 is contacted against the front wall 16*a*. The adhesive layer 24 has a sufficiently strong adherence to the back wall 16*b* to retain the wing portions 22*a*, 22*b* in their flattened states.

Unlike prior known adhesive tapes used to create recloseable bags, the present configuration allows the user the ability to feel the closure strip flex and seal to determine whether the seal is positively closed. The wing portions 22*a*, 22*b* create a spring effect. This feature allows the user to recognize the indication that a positive closure has been achieved since the overall thickness of the closure element 20 is substantially decreased when compressed and retained into the closed condition. Additionally, a failure of the adhesive layer 24 to adequately seal is indicated if the adherence is insufficient to retain the resilient wing portions 22*a*, 22*b* in their flattened state, i.e., the closure element 20 will spring to its uncompressed, thicker, profile.

An additional advantage of the embodiment of FIGS. 2 and 3 is that when the closure element 20 is compressed flat it is substantially only a single thickness closure which can approach the same thickness as the bag wall material as shown in FIG. 3.

Figure 4:
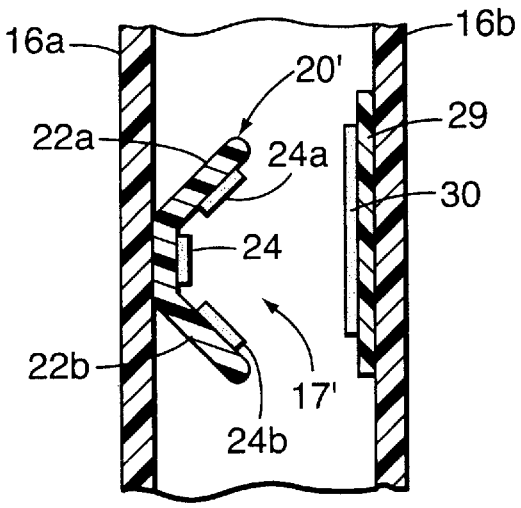
FIG. 4 is a fragmentary sectional view of a first alternate embodiment closure element incorporated into a bag.

As illustrated in FIG. 4, a second strip or a companion strip 29 can be arranged on the back wall 16*b* opposite the closure element. The second strip 29 can carry an adhesive layer 30 facing the closure element.

FIG. 4 also illustrates a modified closure element 20' which includes wing adhesive portions 24*a*, 24*b* applied onto the wing portions 22*a*, 22*b* respectively. When the back wall 16*b* is compressed toward the front wall 16*a*, the second strip 29 flattens the wing portions 22*a*, 22*b* against the back wall 16*b*. The adhesive regions 24, 24*a*, 24*b* compress against the adhesive region 30 to close the opening 17' defined between the modified closure element 20' and the second strip 29.

The adhesive strips 24, 24*a*, 24*b* and 30 can be formed from coadhesives, as known in the art, that will only adhere to like coadhesives, thereby resisting potential contamination from particles of the contained product within the bag, or external particles. A cold sealable, pressure-sensitive cohesive, such as described in U.S. Pat. No. 4,898,787, can be applied to the closure strip and the companion strip. This cohesive has low surface tack and is cohesive only when placed under pressure in contact with other cold sealable cohesive coated surfaces. Thus, the closure strip and the companion strip would not be tacky and adherent to non-coated surfaces such as the product held in the bag, or debris.

U.S. Pat. No. 4,898,787 is hereby incorporated by reference.

An additional advantage of the configurations described in FIG. 4 is that when the bag walls 16*a*, 16*b* are initially compressed together to seal the opening 17', the adhesive regions 24*a*, 24*b* first seal against the front wall 16*a* or the additional strip 29 (with or without adhesive layer 30) forming a prone trapezoidal profile channel before the closure 20 is completely flattened. This trapezoidal channel will progress along the length of the closure 20 as the closure is progressively sealed by the user's fingers sliding along the length of the closure element through the bag walls. As the user's fingers reach the end of the closure element, air trapped within the trapezoidal space is expelled (with a "snap" sound) which gives the user an additional feedback or indication that the bag has been sealed with sufficient pressure.

Figure 5:
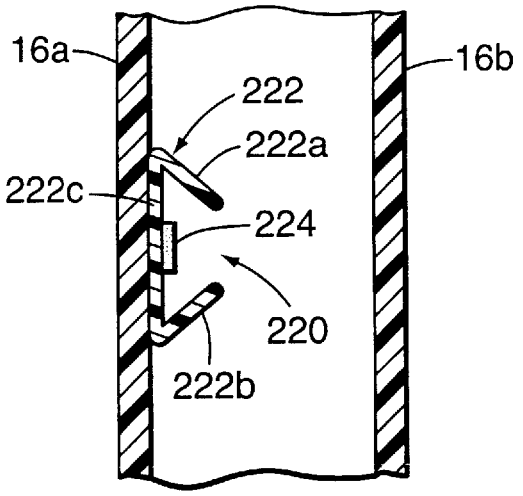
FIG. 5 is a fragmentary sectional view of a second alternate embodiment closure element incorporated into a bag.

FIG. 5 illustrates an alternate closure element 220 having wing portions 222*a*, 222*b* that are arranged angled toward each other inwardly, having a decreasing clearance between wing portions taken forwardly of the base portion 222*c*. During closing, the wing portions are resiliently compressed until the adhesive region 224 engages the front wall 16*a*, or alternately, engages a companion strip 29 such as illustrated in FIG. 4. The wing portions 222*a*, 222*b* are folded against the base 222*c* and have a length such as to not interfere with the adhesive portion 224.

Figure 6:
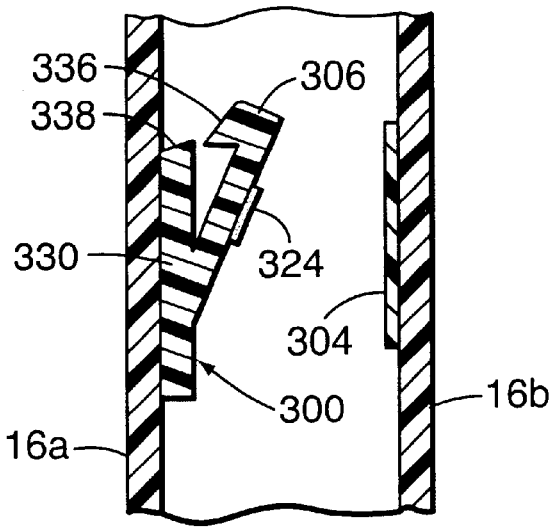
FIG. 6 is a fragmentary sectional view of a third alternate embodiment closure element incorporated into a bag and in an open condition.

FIG. 6 illustrates a further alternate embodiment closure element 300 connected to the front wall 16*a*, and a second strip 304 connected to the back wall 16*b*. The closure element 300 and the second strip 304 are substantially in alignment. The elements 300, 304 are connected by heat sealing, or other known method, to the bag walls 16*a*, 16*b*, respectively. The closure element 300 includes at least one base portion 306 carrying an adhesive region 324 which faces the second strip 304. The base portion 306 is connected to a wing portion 330. The wing portion 330 is heat sealed or otherwise secured to the front wall 16*a*.

The base portion 306 and the wing portion 330 have formations which lock together when the base portion is flattened by pressing force from the strip 304. Particularly, the base portion 306 has a hook portion 336 which engages an angled edge or face 338 of the wing portion 330. The locking engagement provides a sensory field to the user that the closure element 300 is being sufficiently sealed to the strip 304.

Although a second strip 304 is illustrated, in some applications, the second strip can be eliminated and the adhesive strip 324 sealed directly to the bag back wall 16*b*. Alternately, a second strip of adhesive can be applied to the second strip or to the back wall to engage the adhesive strip 324 such as the arrangement illustrated in FIG. 4.

Figure 7:
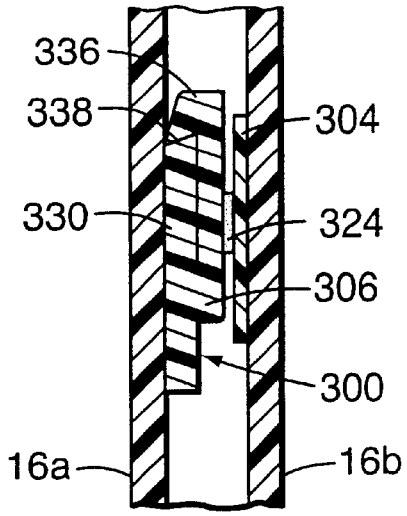
FIG. 7 is a fragmentary sectional view of the closure element of FIG. 6 in a closed condition.

FIG. 7 illustrates the closure element of FIG. 6 in a closed condition. The base portion 306 is pressed flat to the wing portion 330, and the hook portion 336 has engaged the edge 338 of the wing portion 330 in a snap-fitting fashion to give the user a positive indication of the complete closure of the bag opening.

Figure 8:
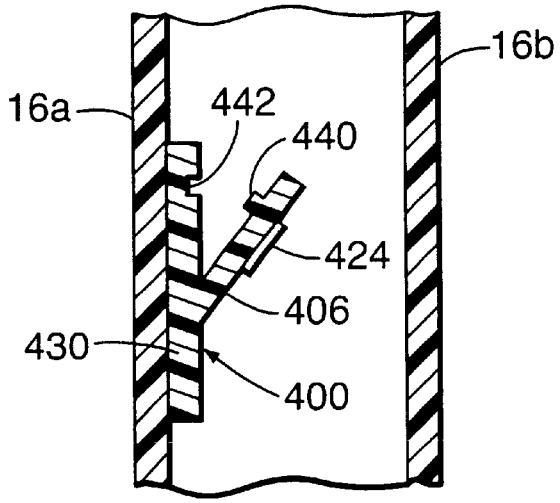
FIG. 8 is a fragmentary sectional view of a fourth alternate embodiment closure element incorporated into a bag and in an open condition.
Figure 9:
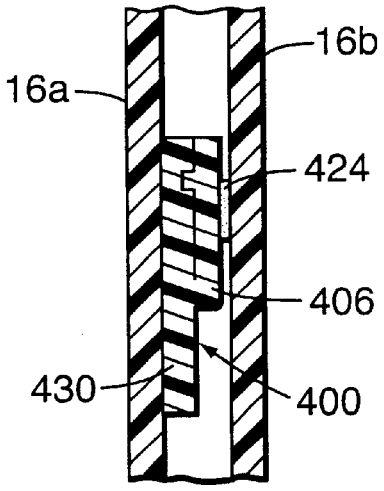
FIG. 9 is a fragmentary sectional view of the closure element of FIG. 8 in a closed condition.

FIG. 8 illustrates another embodiment closure element 400 which includes a base portion 406 resiliently attached to a wing portion 430. The base portion 406 carries an adhesive strip 424 facing the back wall 16*b* of the bag. When the bag is closed, the back wall 16*b* engages the adhesive strip 424 to seal the bag opening. A second strip can be applied to the bag opposite to the closure element 400, such as shown as 304 in FIGS. 6 and 7. Also, a second strip of adhesive can be applied to the second strip or to the back wall to engage the adhesive strip 424 such as illustrated in FIG. 4.

The base portion 406 includes a tongue portion 440 which is aligned to register with a groove 442 formed in the wing portion 430. The tongue portion is sufficiently sized to provide a resilient fit or squeeze fit within the groove so that a user is provided with a positive feel of resealing the bag. The pressure required to seat the tongue portion 440 within the groove is sufficient to ensure that the adhesive has been sufficiently pressed to the back wall 16*b* (or to the second strip on the back wall as applicable).

An additional advantage of the closure element embodiments of FIGS. 2 through 5 is that the wing portions are such as to tend to shelter the adhesive strip from contamination, particularly from products being removed from the bag, past the closure strip. The products tend to be directed or deflected away from the adhesive portion by the presence of the extending wing portions.

Although in the above embodiments the closure strip is described as being attached to the front wall of the bag, the closure strip could be attached to the back wall of the bag and any companion strip attached to the front wall of the bag without departing from the scope of the invention.

Many of the various embodiments of the invention could be interchanged, such as the companion strip of FIG. 4 and FIG. 6 and the cohesive properties of the closure of FIG. 4 could be utilized by any of the embodiments, given an application of cohesive material on the strip and on the coacting companion strip or bag wall. The bags of FIGS. 1, 1A or 1B could be formed with the closure strips at an orientation other than those illustrated such as rotated 90°, to name just a few examples.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A closure for a recloseable opening, comprising:

a base strip portion having a first surface and a second surface;

an adhesive portion carried on said second surface of said base portion;

a resilient first wing portion extending from said base portion in an oblique direction, said first wing portion flexibly connected to said base portion; and a companion strip for compressing against said adhesive portion by flattening said resilient wing portion thereby closing said opening; and a further adhesive strip carried on a wing surface of said first wing portion, said wing surface contiguous with said second surface of said base portion.

2. The closure according to claim 1, further comprising a second wing portion extending obliquely from said base portion, said second wing portion resiliently flexibly connected to said base portion, said first and second wing portions and said base portion forming a trough-shaped profile which is flattened by compressing said companion strip thereagainst.

3. The closure according to claim 2, wherein said trough shape of profile has an increasing clearance between wing portions taken in a direction away from said base portion.

4. The closure according to claim 1, wherein said base portion and said wing portion are wound in a coil to be dispensed for application to a flexible web.

5. A recloseable bag, comprising:

a first wall and second wall sealed together at their lateral edges and at one end edge, said bag having an opening located substantially at an end opposite to said one end;

an elongate resilient structure having a first surface connected to said first wall, and a second surface, said resilient structure comprising a base strip portion providing said first and second surfaces, and at least one resilient wing portion extending in an oblique direction from said base portion, said structure comprising an adhesive portion carried on said second surface of said base portion; and a companion strip mounted on a second wall of said bag, said companion strip being arranged to be completely adhered to said base portion by the adhesive strip thereon to close said opening when said resilient structure is in a flattened state.

6. The bag according to claim 5, wherein said elongate resilient structure has a trough shape in an uncompressed state, with a base portion and two forwardly extending wing portions, said first surface being a rearwardly facing surface of said base portion and said second surface being a forwardly facing surface of said base portion.

7. The bag according to claim 6, wherein said wing portions extend away from each other.

8. A recloseable bag in accordance with claim 5, including:

another adhesive strip carried on said companion strip.

9. A method of closing an opening of a flexible bag, comprising the steps of:

providing a bag having an opening;

attaching a compressible member to the bag on one side of the opening, said compressible member having a trough shape including a base portion and a pair of wing portions each extending integrally obliquely from said base portion, the base portion of the compressible member having a resealable adhesive strip applied thereto and attaching a companion strip to the bag on the other side of said opening;

compressing said bag and said companion strip against said compressible member to flatten said compressible member from said trough shape, and sealing said opening with said adhesive strip by adherence to said companion strip.

10. A closure for a recloseable opening, comprising:

a base strip portion having a first surface and a second surface;

an adhesive portion carried on said second surface of said base portion;

a resilient first wing portion extending from said base portion in an oblique direction, said first wing portion flexibly connected to said base portion; and a companion strip for compressing against said adhesive portion by flattening said resilient wing portion thereby closing said opening; and a second wing portion extending obliquely from said base portion, said second wing portion resiliently flexibly connected to said base portion, said first and second wing portions and said base portion forming a trough-shaped profile which is flattened by compressing said companion strip thereagainst, including a first further adhesive strip carried on a first wing surface of said first wing portion, and a second further adhesive strip carried on a second wing surface of said second wing portion, said first and second wing surfaces contiguous with said second surface of said base portion.

* * * * *